United States Patent [19]

Hill

[11] 4,203,383

[45] May 20, 1980

[54] BURGLAR ALARM

[76] Inventor: Michael D. Hill, P.O. Box 701, Columbia, Tenn. 38401

[21] Appl. No.: 2,847

[22] Filed: Jan. 12, 1979

[51] Int. Cl.[2] ..... G08B 13/08

[52] U.S. Cl. ..... 116/95; 116/5; 116/152; 116/215

[58] Field of Search ..... 116/95, 86, 87, 85, 116/77, 100, 67 R, 169, 152, 75, 148, 215, 12, 13, 4, 5, 307, 78; 109/43; 49/13; 206/223, 573; 46/191

[56] References Cited

U.S. PATENT DOCUMENTS

| | | | |
|---|---|---|---|
| 713,782 | 11/1902 | MacDonald | 116/78 |
| 1,003,636 | 9/1911 | Mohler | 116/148 |
| 1,483,708 | 2/1924 | Bell | 116/215 |

*Primary Examiner*—Gerald Goldberg
*Assistant Examiner*—Denis E. Corr
*Attorney, Agent, or Firm*—Abe Hatcher

[57] ABSTRACT

A gong or bell attached to a door such that when a thief breaks open the door, a ball or like object having a rod extending therethrough and resting on a ledge which projects from the top of a frame for the door, falls along the rod as the ball or like object is pushed with the door out of a slot in the ledge and rings the gong or bell by striking it.

6 Claims, 3 Drawing Figures

BURGLAR ALARM

BACKGROUND OF THE INVENTION

1. Field of the Invention

This invention relates to burglar alarms. More particularly, it relates to a non-electrical bell adapted to be affixed to a door in such a manner that it sounds when the door is opened.

2. Description of the Prior Art

Numerous door burglar alarms are known which are adapted to sound when a door is opened. However, such alarms are generally of complex structure, require electrical connections and must be disconnected when someone is at home during daylight hours.

SUMMARY OF THE INVENTION

After extended investigation I have found that, by providing a removable ball or like object adapted to fall and strike a mechanical gong or bell when a door is opened such complex structure and electrical connections may be avoided. In its broader aspects, my invention involves, as cooperative components, (1) a mechanical gong or bell adapted to be fastened to the inside of a door, (2) a bracket or ledge having a slot or groove therein said bracket being adapted to be fastened to the top of said door frame, (3) a spherical, rectangular or like object having a hole therethrough and adapted to rest on said bracket except when the gong or bell is in use and (4) a rod adapted to be bolted, screwed or welded at one end thereof to said gong or bell and to project through said slot and said hole toward the other end thereof when said object is resting on said bracket or ledger. When installed on a door and door frame, the burglar alarm operates by the ball or similar object falling along the rod and sounding an alarm by ringing the gong or bell by striking it when the door is opened far enough for the rod to slip out of the slot or grove in the bracket or ledge and let the ball fall. When someone is at home during the daytime and does not wish to be distrubed by the alarm when another member of the family comes in, the ball may be left in a drawer or other suitable location, if desired. The aforesaid components, together with the necessary parts for the assembly thereof on a door and door frame, may make up a kit which may be used by a builder, carpenter, homeowner or other individual or group.

DESCRIPTION OF THE DRAWING AND OF THE PREFERRED EMBODIMENT OF THE INVENTION

For a better understanding of the invention, reference will now be made to the drawing, which forms a part hereof, and the description of which represents the preferred embodiment of the invention.

Figure 1:
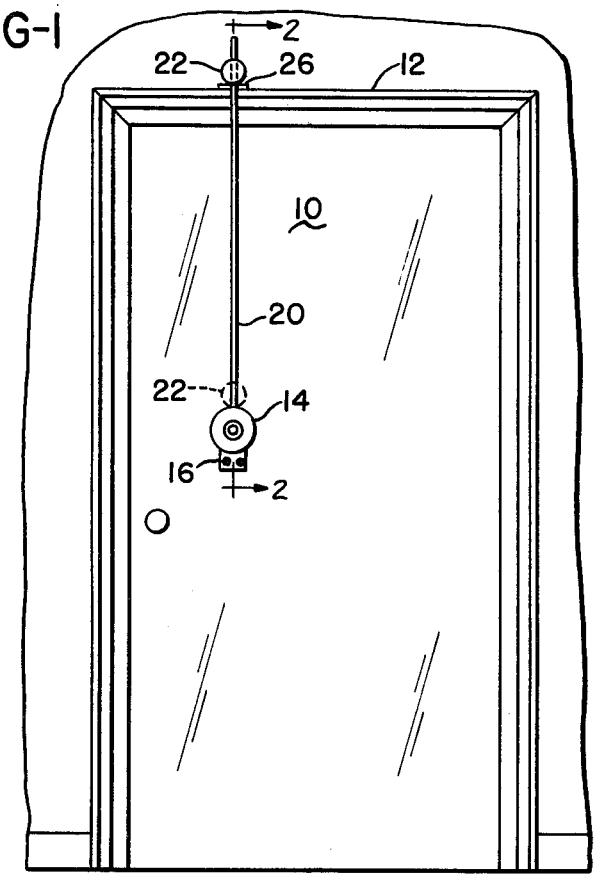
FIG. 1 is a perspective elevation view from one side of the door showing a door and door frame with the alarm apparatus of the invention in assembled form installed thereon.
Figure 2:
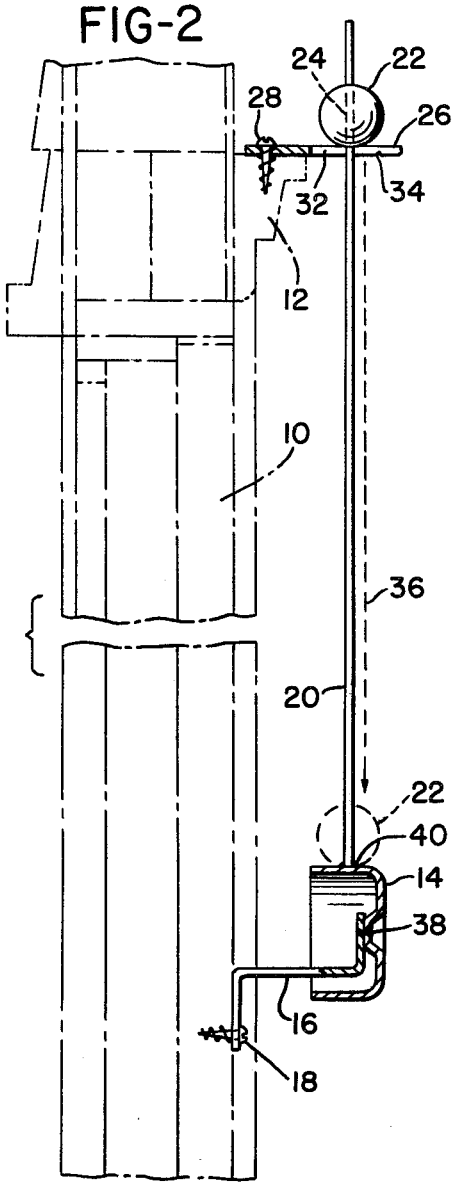
FIG. 2 is an enlarged perspective view, of the alarm apparatus, partly sectional, taken at 2—2 of FIG. 1, with door and frame in phantom, showing how the components are put together in a working manner and joined to the door and door frame.
Figure 3:
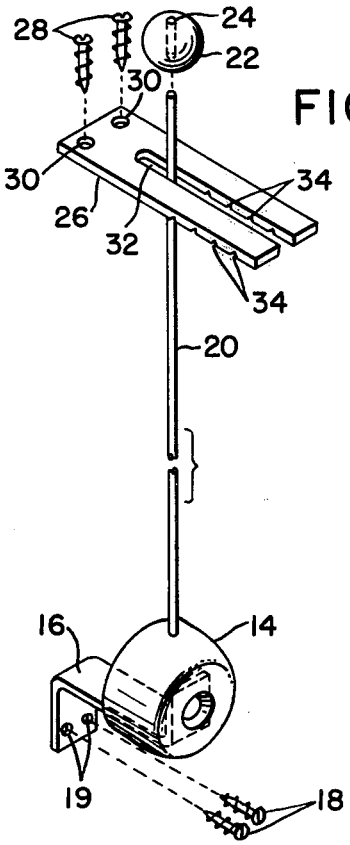
FIG. 3 is an perspective view from an angle showing the components of the alarm device of the invention as described hereinabove as well as screws which may be used to install the device.

The alarm apparatus as depicted in the drawing and adapted, as shown, to be installed on a door 10 and door frame 12, is made up of (1) a bell 14 with a rod 20 extending substantially vertically therefrom (which rod may be bolted thereto, if desired, rather than being welded, at 40, as shown in FIG. 2), which bell 14 may be attached to a door such as 10 by means of a bracket 16 having holes 19 therein and screws such as 18, the bracket 16 being joined to the bell 14 by spot welding or bolting at 38, (2) a ball or similar object 22 with a hole 24 therethrough and (3) a ball-retaining bracket or ledge 26 having a slot or groove 32 therein, as well as notches 34 to assist in removing sections thereof, and screws 28 for inserting through holes 30 (as shown in FIG. 3) to join said bracket or ledge to the top of door frame 12. When the door is opened, ball 22 and rod 20 slip out of notch 32 with ball 22 falling down rod 20 in the direction shown by dotted arrow line 36 to dotted line position 22 and, upon striking bell 14, ringing it.

While the invention has been described in terms of preferred embodiments, the claims appended hereto are intended to encompass all embodiments which fall within the spirit of the invention.

Having thus described my invention and certain preferred embodiments thereof, I claim:

1. An assembly of components in a kit, said assembly being adapted for assembly together and affixing to a door and door frame as a burglar alarm, said assembly comprising (1) a mechanical bell adapted to be fastened to the inside of a door, (2) a bracket having a slot therein, said bracket being adapted to be fastened to the top of said door frame, (3) an object having a hole therethrough and adapted to rest on said bracket and (4) a rod to be joined at one end thereof to said bell and to project through said slot and said hole toward the other end thereof.

2. The assembly of claim 1 wherein said object comprises a ball.

3. The assembly of claim 1 comprising additionally screws and at least one additional bracket for putting said assembly together and affixing same to said door frame.

4. The assembly of claim 1 wherein said bracket has notches therein adapted for removing one or more sections thereof.

5. An assembly of components in a kit, said assembly being adapted for assembly together and affixing to a door frame as a burglar alarm, said assembly comprising (1) a mechanical bell adapted to be fastened to the inside of a door, (2) a bracket having a slot therein, said bracket being adapted to be fastened to the top of said door frame, (3) an object having a hole therethrough and adapted to rest on said bracket and (4) a rod to be joined at one end thereof to said bell and to project through said slot and said hole toward the other end thereof, with said components assembled together and said assembly affixed to a door and door frame, whereby said object falls and sounds an alarm when said door is opened.

6. The assembly of claim 5 attached to a door and door frame as an integral unit and having said bracket screwed to said door frame, said bell mounted on said door by a second bracket and screws and said second bracket joined to said bell.

* * * * *